US009188133B1

(12) United States Patent
Richardson et al.

(10) Patent No.: US 9,188,133 B1
(45) Date of Patent: Nov. 17, 2015

(54) TURBOCHARGER COMPRESSOR ACTIVE DIFFUSER

(71) Applicant: BorgWarner Inc., Auburn Hills, MI (US)

(72) Inventors: Andrew Richardson, Huddersfield (GB); Simon Slater, Wyke (GB); Andrew Taylor, Mirfield (GB)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 14/593,145

(22) Filed: Jan. 9, 2015

(51) Int. Cl.

| | |
|---|---|
| ***F04D 29/14*** | (2006.01) |
| ***F04D 29/063*** | (2006.01) |
| ***F04D 29/056*** | (2006.01) |
| ***F04D 17/10*** | (2006.01) |
| ***F04D 29/46*** | (2006.01) |

(52) U.S. Cl.
CPC ..... *F04D 29/143* (2013.01); *F04D 17/10* (2013.01); *F04D 29/056* (2013.01); *F04D 29/063* (2013.01); *F04D 29/462* (2013.01)

(58) Field of Classification Search
CPC ..... F04D 17/10; F04D 29/14; F04D 29/143; F04D 29/063; F04D 29/083; F04D 29/16; F04D 29/161; F04D 29/162; F04D 29/441; F04D 29/462; F04D 29/122; F04D 29/056; F05D 2240/55; F05D 2260/98
See application file for complete search history.

(56) References Cited

U.S. PATENT DOCUMENTS

| | | | | | |
|---|---|---|---|---|---|
| 916,427 | A * | 3/1909 | Fee | 415/26 |
| 3,289,919 | A * | 12/1966 | Wood | 415/150 |
| 3,728,857 | A * | 4/1973 | Nichols | 62/469 |
| 3,784,318 | A * | 1/1974 | Davis | 415/158 |
| 3,874,677 | A * | 4/1975 | Ludwig et al. | 277/425 |
| 4,219,305 | A * | 8/1980 | Mount et al. | 415/13 |
| 4,236,867 | A * | 12/1980 | Morris | 415/26 |
| 4,257,733 | A * | 3/1981 | Bandukwalla et al. | 415/13 |
| 4,265,589 | A * | 5/1981 | Watson et al. | 415/47 |
| 4,378,194 | A * | 3/1983 | Bandukwalla | 415/49 |
| 4,460,310 | A * | 7/1984 | Plunkett | 415/26 |
| 4,472,107 | A * | 9/1984 | Chang et al. | 415/104 |
| 4,611,969 | A * | 9/1986 | Zinsmeyer | 415/1 |
| 4,828,454 | A * | 5/1989 | Morris et al. | 415/48 |
| 4,932,835 | A * | 6/1990 | Sorokes | 415/150 |
| 5,297,928 | A * | 3/1994 | Imakiire et al. | 415/112 |
| 6,139,262 | A * | 10/2000 | Ravidranath | 415/150 |
| 6,368,077 | B1 | 4/2002 | Meyerkord et al. | |
| 6,857,845 | B2 * | 2/2005 | Stabley et al. | 415/1 |
| 6,966,746 | B2 | 11/2005 | Cardenas et al. | |
| 7,252,474 | B2 * | 8/2007 | Belokon et al. | 415/1 |
| 7,326,027 | B1 * | 2/2008 | Skoch et al. | 415/17 |
| 2005/0175446 | A1 * | 8/2005 | Garner | 415/170.1 |
| 2011/0255963 | A1 * | 10/2011 | Kim | 415/211.2 |

* cited by examiner

*Primary Examiner* — Nathaniel Wiehe
*Assistant Examiner* — Wayne A Lambert
(74) *Attorney, Agent, or Firm* — BrooksGroup

(57) ABSTRACT

A product is disclosed for inhibiting oil from entering a turbocharger compressor. A compressor wheel may be disposed in a wheel chamber of a housing to rotate at a range of speeds. The compressor wheel may be surrounded by a collection volute with a diffuser channeling air from the wheel chamber to the collection volute. A shaft may extend through the housing and may be connected to the compressor wheel. The shaft may be supported by a bearing that may be lubricated through an oil circuit. A pressure differential between the wheel chamber and the oil circuit inhibits oil from entering the wheel chamber. The pressure differential may be maintained during rotation of the compressor wheel at a low end of the range of speeds by a collar disposed near a tip of the compressor wheel at an entrance to the diffuser.

17 Claims, 4 Drawing Sheets

TURBOCHARGER COMPRESSOR ACTIVE DIFFUSER

TECHNICAL FIELD

The field to which the disclosure generally relates includes turbochargers for use with internal combustion engines and more particularly, includes turbochargers with an exhaust driven rotary turbine that drives a compressor to charge an engine's air intake system.

BACKGROUND

An exhaust driven turbocharger may be used with an internal combustion engine to compress air delivered to the engine's intake air system. The turbocharger may include a compressor rotor driven by a connected turbine rotor. The compressor may include a housing that channels intake aft and the turbine may include a housing that channels exhaust gases. The compressor housing may be spaced apart from the turbine housing by a bearing housing containing bearings that support a shaft connecting the turbine rotor to the compressor rotor.

The compressor rotor, the shaft and the turbine rotor may rotate at speeds that approach hundreds of thousands of revolutions per minute. In addition, the turbine rotor operates in a high temperature exhaust gas environment, wherein heat may be transferred to the other turbocharger system components. Under these harsh, and increasingly demanding operating conditions, the lifespan of a turbocharger is expected to match that of the engine with which it operates. To accomplish that challenge, the design of a turbocharger and its components must be robust to survive as expected, while still being cost effective. As a result, a turbocharger is designed to exacting tolerances and standards.

To reduce friction in the bearings, the bearing housing may include an oil delivery system to provide lubrication. Oil may be provided by the associated engine's pressurized oil delivery system and may be channeled through the bearing housing to the bearings and other rotating parts. The oil may then be collected and allowed to drain back to the engine's sump. Maintaining the integrity of the lubrication circuit is essential so that the oil level in the associated engine is not depleted, and so that oil does not enter unwanted areas.

SUMMARY OF ILLUSTRATIVE VARIATIONS

A product according to a number of variations may inhibit oil from entering a turbocharger compressor. A compressor wheel may be disposed in a wheel chamber of a housing to rotate at a range of speeds. The compressor wheel may be surrounded by a collection volute with a diffuser channeling air from the wheel chamber to the collection volute. A shaft may extend through the housing and may be connected to the compressor wheel. The shaft may be supported by a bearing that may be lubricated through an oil circuit. A pressure differential between the wheel chamber and the oil circuit may inhibit oil from entering the wheel chamber. The pressure differential may be maintained during rotation of the compressor wheel at a low end of the range of speeds by a collar disposed near a tip of the compressor wheel at an entrance to the diffuser. The pressure differential may maintain oil in the lubrication circuit.

Other illustrative variations within the scope of the invention will become apparent from the detailed description provided herein. It should be understood that the detailed description and specific examples, while disclosing variations within the scope of the invention, are intended for purposes of illustration only and are not intended to limit the scope of the invention.

BRIEF DESCRIPTION OF THE DRAWINGS

Select examples of variations within the scope of the invention will become more fully understood from the detailed description and the accompanying drawings, wherein.

DETAILED DESCRIPTION OF ILLUSTRATIVE VARIATIONS

Figure 1:
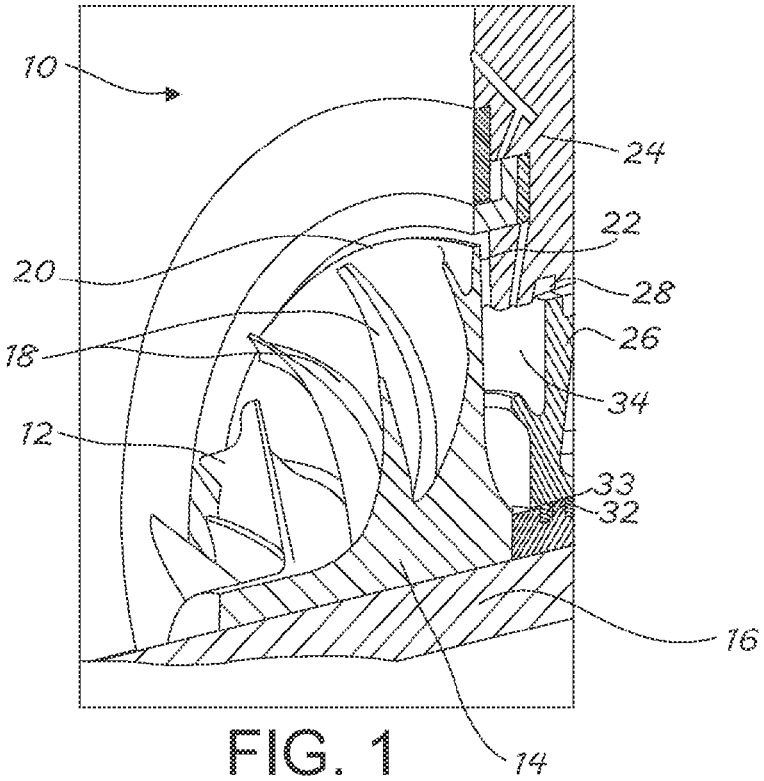
FIG. 1 is a partial perspective sectioned illustration of the wheel area of a compressor according to a number of variations.

In a number of illustrative variations of turbocharger systems for internal combustion engines, oil migration into the compressor housing is impeded. Referring to FIG. 1, an illustration is provided of a turbocharger system 10 viewed from the compressor 12 end with the compressor housing removed. A compressor wheel 14 may be connected to a shaft assembly 16 to rotate therewith over a wide range of speeds. The compressor wheel 14 may have a number of vanes 18 to induce air flow. The compressor wheel 14 may include a circumferential tip 20 from which flow is directed radially outward. A turbine side or back 22 of the compressor wheel 14 may be disposed adjacent a central housing, referred to as a bearing housing 24. A seal ring insert wall 26 may be annular in shape and may be disposed between a slot 28 that may have a retaining ring disposed therein, and the shaft assembly 16. The shaft assembly 16 may include a number of grooves 32 that may contain piston type seal rings 33 to provide a seal around the shaft assembly 16, and which may comprise part of the bearing feature. The bearing housing 24 may use a lubrication system to lubricate moving parts. The lubrication system may be connected to an associated engine's pressurized oil distribution circuit. To inhibit the migration of oil from the bearing housing 24 to the compressor wheel chamber 34, pressure generated by the compressor wheel 14 in the compressor wheel chamber 34 may be higher than pressure inside the bearing housing 24 when the compressor wheel 14 is rotating at relatively fast speeds. It has been found that when the compressor wheel 14 may rotate at a low end of its rotational speed range, such as during engine idle or deceleration, the pressure in the compressor wheel chamber 34 may drop, particularly at the back 22 side.

Figure 2:
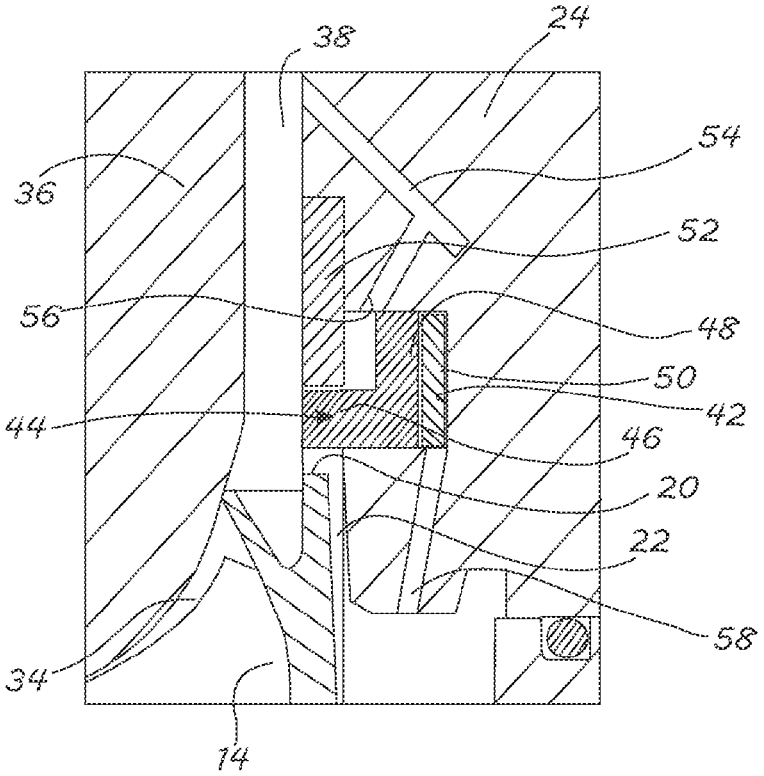
FIG. 2 is a partial sectional illustration of the diffuser area of a compressor of FIG. 1 with a collar in a first position according to a number of variations.

Referring additionally to FIG. 2, the compressor wheel 14 may be disposed in a compressor housing 36 showing a channel or diffuser 38 extending from the compressor wheel chamber 34 to a collection volute that may extend around the compressor housing 36. As the compressor wheel 14 rotates, air is drawn from the inlet through compressor wheel chamber 34 and expelled through diffuser 38 to the collection volute for delivery to the intake system of the associated engine.

Figure 3:
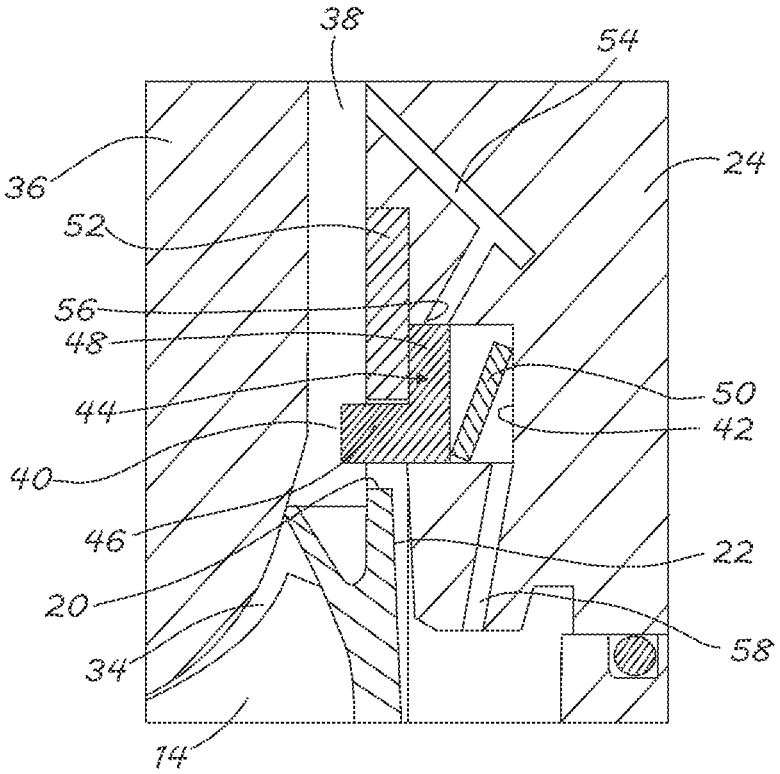
FIG. 3 is a partial sectional illustration of the diffuser area of a compressor of FIG. 1 with a collar in a second position according to a number of variations.

The bearing housing 24 may include an annular groove 42 located at a position that is radially outside the circumferential tip 20 of compressor wheel 14 and opens to the diffuser 38. A collar 44 may be annular in shape with an axially disposed leg 46 and an integral radial disposed leg 48, and may be configured to operate to provide an active diffuser. In the illustration of FIG. 2, the collar 44 is shown in an activated position where the static pressure in compressor wheel chamber 34 causes the collar to slide into the groove 42 and out of the diffuser 38. The collar 44 may be disposed in the annular groove 42 so that when the collar 44 slides outward from the groove 42, the axially disposed leg 46 may slide into the diffuser 38 near the circumferential tip 20 as shown in FIG. 3. This may narrow the width of the flow channel 40 provided to the diffuser 38 which may result in an increase in pressure within the compressor wheel chamber 34 including on the back 22 side of the compressor wheel 14. An increase in pressure may assist in maintaining oil in the bearing housing 24 and inhibit migration past the piston rings 33.

The collar 44 may be biased to slide outward in the groove 42 by a spring 50 that is positioned in a chamber of the groove 42 as shown in FIG. 3. This corresponds to an at rest position where the pressure in compressor wheel chamber 34 is inadequate to overcome the force of spring 50. To hold the collar 44 in the groove 42 a retaining ring 52 may be fixed in the bearing housing 24 and may extend radially inward past a portion of the groove 42 to engage the radial disposed leg 48 so that the collar 44 is maintained in the groove 42. The retaining ring 52 may be flush with the diffuser side of the bearing housing 24. When pressure in the compressor wheel chamber 34 and diffuser 38 is relatively low such as during rotation of the compressor wheel 14 at the low end of its speed range, the spring 50 may push the collar 44 outward from the groove 42 as shown in FIG. 3. This positions the axially extending leg 46 into the diffuser 38 resulting in the narrowed diffuser channel 40. This is also the at rest position established by the spring 50 when the compressor wheel 14 is not turning. When the compressor wheel 14 is turning at a relatively high speed, pressure in the compressor wheel chamber 34 moves collar 44 to slide inward in the groove 42 compressing the spring 50 and fully opening the diffuser 38 as shown in FIG. 2. The leg 46 may be close to the tip 20 of the compressor wheel 14, preferably within 5 millimeters to increase pressure behind the compressor wheel 14.

The collar 44 may have a groove (not shown), with a seal or seals to inhibit pressure leakage around the collar 44. An opening 54 may be bored in the bearing housing 24 between the diffuser 38 and the groove 42 with a port 56 opening to the groove 42 behind the retainer 52. The opening 54 may allow pressure to communicate from the diffuser 38 to the groove 42 to assist in moving the collar 44 into the groove 42 as pressure builds in response to increased rotational speed of the compressor wheel 14. A vent 58 opening may be bored through the bearing housing 24 into the groove 42 to allow air to escape from behind the collar 44. The vent 58 may extend to a point outside the bearing housing 24 or to a point inside the bearing housing 24. Through the foregoing structure, pressure is provided both at relatively low rotational speeds and relatively high rotational speeds, sufficient to inhibit leakage of oil from the bearing housing 24 to the compressor wheel chamber 34. At higher rotational speeds of the compressor wheel 14, the diffuser 38 is not obstructed by the sliding collar 44, optimizing flow efficiency.

Figure 4:
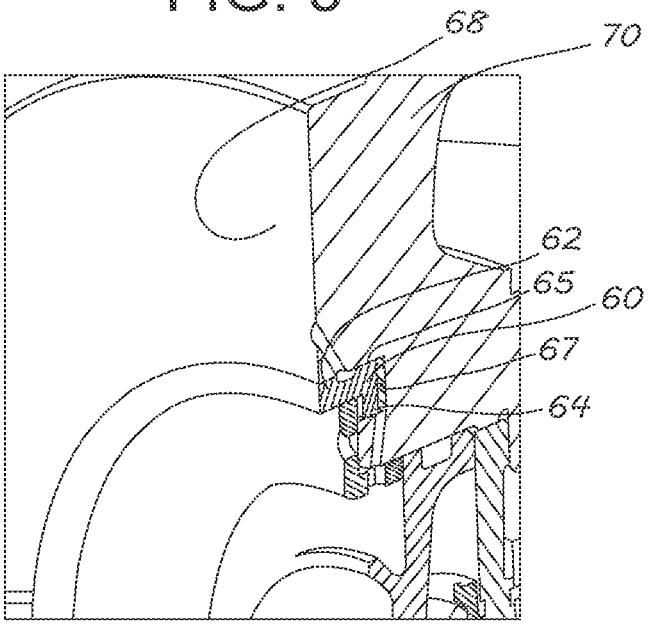
FIG. 4 is a partial perspective sectioned illustration of the wheel area of a compressor according to a number of variations.

FIG. 4 illustrates a product according to a number of additional illustrative variations where the collar 60 may include an axially extending leg 62 and a radially extending leg 64. The leg 64 may extend along, and in contact with, the radial outer wall 65 of the groove 67. The collar 60 may slide in the groove 67 so that the leg 62 may protrude from the wall 68 of bearing housing 70 as shown in FIG. 6, and alternately may recede into the groove 67 as shown in FIGS. 4 and 5.

Figure 5:
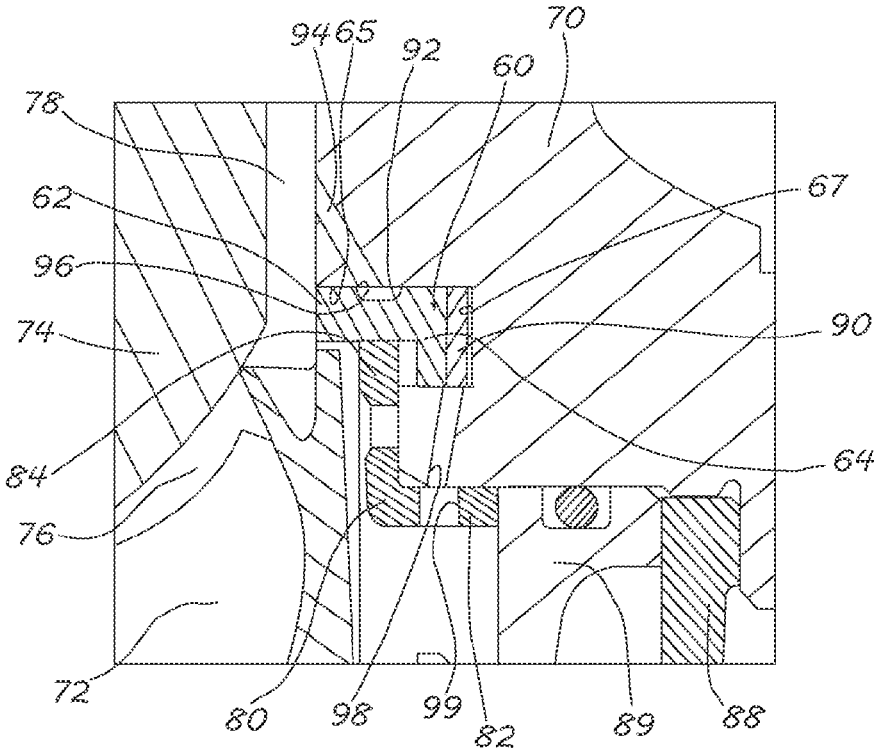
FIG. 5 is a partial sectional illustration of the diffuser area of a compressor of FIG. 4 with a collar in a first position according to a number of variations.
Figure 6:
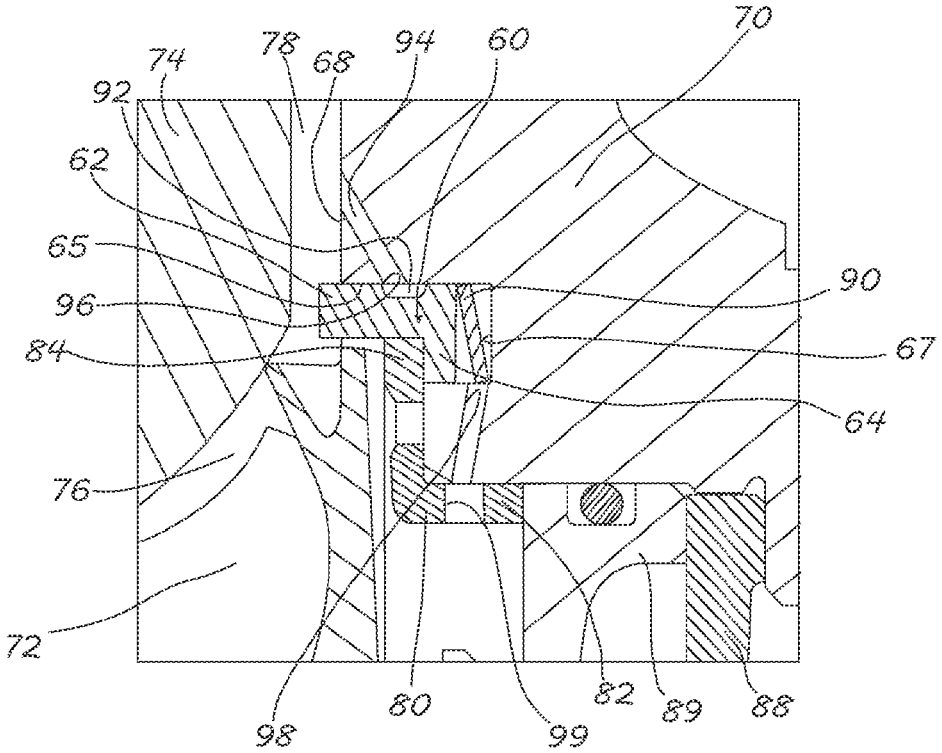
FIG. 6 is a partial sectional illustration of the diffuser area of a compressor of FIG. 4 with a collar in a second position according to a number of variations.

Referring additionally to FIGS. 5 and 6, a compressor wheel 72 is shown disposed in a compressor housing 74, with a compressor wheel chamber 76 and a diffuser 78 channel defined. The collar 60 may be maintained in the groove 67 by a retaining ring 80 that is fixed to the bearing housing 70 with an axially extending leg 82 and a radially extending leg 84. The leg 82 may retain a thrust bearing 88 and a seal ring insert wall 89 in the bearing housing 70. The leg 84 may overlap with the leg 64 of the collar 60 in the radial direction to keep the collar 60 in the groove 67 and limit its extension into the diffuser 78.

As shown in FIGS. 5 and 6, a spring 90 may be positioned in the groove 67 behind collar 60 biasing the collar 60 to slide outward from the groove 67. The leg 62 may include a cavity 92 in its radially outer surface. An opening 94 may be bored through the bearing housing 70 between the diffuser 78 and the groove 67. The opening 94 may open to the groove 67 at a port 96 that may be aligned with the cavity 92. The opening may allow pressure at the diffuser 78 to communicate to the cavity 92 to ensure the pressure at the diffuser 78 is experienced by the collar 60, and to help move the collar 60. A vent 98 may be bored through the bearing housing 70 into the groove 67. The vent 98 may allow pressure to escape from the void behind the collar 60 so that trapped air does not inhibit movement of the collar 60. The retaining ring 80 may include an opening 99 through the leg 82 that registers with the vent 98 to open the vent 98 to the interior of the bearing housing 70. When the compressor wheel 72 may be at rest or may rotate at speeds near the lower end of its rotational speed range, the spring 90 may cause the collar 60 to slide outward in the groove 67 with the leg 62 extending into the diffuser 78 increasing pressure in the compressor wheel chamber 76. When the compressor wheel 72 may rotate at higher speeds above the low end of its rotational speed range, the pressure generated may overcome the force of spring 90 causing the collar 60 to slide into the groove 67 as shown in FIG. 5. In this way, pressure behind the compressor wheel 72 may be consistently maintained at a level that inhibits infiltration of oil from the bearing housing 70 to the compressor wheel chamber 76, without decreasing flow efficiency during higher speeds.

Figure 7:
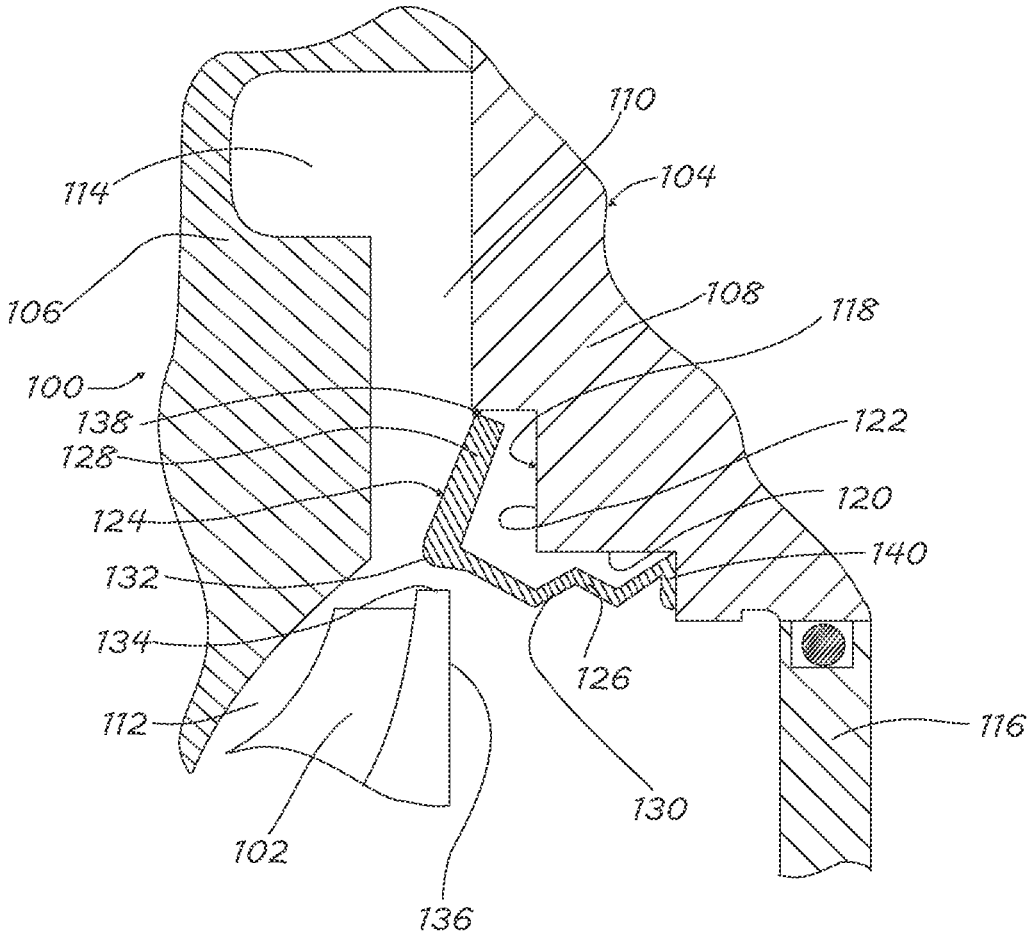
FIG. 7 is a schematic illustration of the diffuser area of a compressor according to a number of variations.

Referring to FIG. 7, a product 100 according to a number of additional illustrative variations is shown in schematic form. A compressor wheel 102 may be disposed for rotation in a housing 104 that may be comprised of a compressor housing section 106 and a bearing housing section 108. A diffuser 110 may provide a channel extending radially from a compressor wheel chamber 112 to a collection volute 114. An insert wall 116 may extend around the compressor wheel's shaft (not shown), and may help separate the compressor wheel cavity 112 from a lubricated area of the bearing housing section 108. An L-shaped annular grove 118 may be formed in the bearing housing section 108, with an axially extending groove section 120 and a radially extending groove section 122.

A collar 124 may be annular in shape with an axial directed leg 126 positioned in the axially extending groove section 120 and an integral radial directed leg 128 positioned at least partially in radially extending groove section 122, and may be configured to operate in providing an active diffuser. The collar 124 may be configured with a spring section 130 in leg 126 to bias the radial inside end 132 of leg 128 outward from the groove 118, and into the diffuser 110 near the circumferential tip 134 of the compressor wheel 102. This may narrow the width of the flow channel provided by the diffuser 110 which may result in an increase in pressure within the compressor wheel chamber 112 including on the back 136 side of the compressor wheel 102. An increase in pressure may assist in maintaining oil in the bearing housing section 108 and inhibit migration of oil past the insert wall 116 into compressor wheel cavity 112. When the compressor wheel 102 may rotate at speeds above the low end of its rotational speed range, the pressure may overcome the force of spring section 130 compressing the collar 124 and fully moving the leg 128 into the groove section 122. As a result, the diffuser may be open from the tip 134 radially outward, without restricting flow. The collar 124 may be formed as one piece from a thermoplastic or other material suitable for the application including the spring section 130. The leg 128 may be held in the groove section 122 by a retainer 138 and the leg 126 may be held in the groove section 120 by a retainer 140.

Through the foregoing illustrative variations, a turbocharger system may be provided with an active diffuser responsive to pressure generated by a compressor wheel to retain oil in a bearing housing by maintaining a pressure differential between the compressor wheel's cavity and the bearing housing. The following description of variants is only illustrative of components, elements, acts, products and methods considered to be within the scope of the invention and is not in any way intended to limit such scope by what is specifically disclosed or not expressly set forth. Components, elements, acts, products and methods may be combined and rearranged other than as expressly described herein and still are considered to be within the scope of the invention.

Variation 1 may involve a product that may inhibit oil from entering a turbocharger compressor. A compressor wheel may be disposed in a wheel chamber of a housing to rotate at a range of speeds. The compressor wheel may be surrounded by a collection volute with a diffuser channeling air from the wheel chamber to the collection volute. A shaft may extend through the housing and may be connected to the compressor wheel. The shaft may be supported by a bearing that may be lubricated through an oil circuit. A pressure differential between the wheel chamber and the oil circuit inhibits oil from entering the wheel chamber. The pressure differential may be maintained during rotation of the compressor wheel at a low end of the range of speeds by a collar disposed near a tip of the compressor wheel at an entrance to the diffuser. The pressure differential may maintain oil in the lubrication circuit.

Variation 2 may include a product according to variation 1 and may include a spring biasing the collar toward the wheel. During rotation of the wheel at speeds above the low end of the range of speeds, the pressure differential may cause the collar to slide to compress the spring.

Variation 3 may include a product according to variation 2 wherein during rotation of the wheel at the low end of the range of speeds the spring may bias the collar to direct air from a tip of the wheel to a shaft side of the wheel, to increase pressure on the shaft side of the wheel.

Variation 4 may include a product according to variation 2 or 3 wherein the spring may be disposed in a chamber of the housing behind the collar and wherein a vent may extend from the chamber and through the housing.

Variation 5 may include a product according to any of variations 1 through 4 and may include a retainer engaged in the housing. The retainer may hold the collar in a groove of the housing. An opening may extend through the housing from the diffuser to the groove. The opening may enter the groove at a port located between the retainer and the collar.

Variation 6 may include a product according to any of variations 1 through 5 wherein the collar may be disposed in a groove of the housing. The collar may include a cavity. An opening may extend through the housing from the diffuser to the groove. The opening may enter the groove at a port that is aligned with the cavity.

Variation 7 may include a product according to variation 1 wherein the collar may include a disk section extending along the diffuser and a spring section joining with the disk section and biasing the disk section to vary the diffuser in response to the pressure differential.

Variation 8 may involve a product for use with a turbocharger. A compressor wheel may be connected to and may rotate with a shaft. The compressor wheel may be disposed in a compressor housing. A bearing may be disposed in a bearing housing and may rotatably support the shaft. The bearing housing may include an annular groove formed in a radial location outside a circumferential tip of the compressor wheel. A collar may be disposed in the annular groove. The collar may slide in the groove in an outward direction when the compressor wheel rotates at a relatively slow speed and the collar may slide in the groove in an inward direction when the compressor wheel rotates at a relatively fast speed.

Variation 9 may include a product according to variation 8 and may include a spring biasing the collar in the outward direction. During rotation of the compressor wheel at the relatively fast speed, a pressure differential may cause the collar to slide in the inward direction.

Variation 10 may include a product according to variation 8 or 9 wherein during rotation of the compressor wheel at the relatively low speed, a spring may cause the collar to slide in the outward direction.

Variation 11 may include a product according to any of variations 8 through 10 and may include a retainer engaged in the bearing housing. The retainer may hold the collar in the annular groove of the bearing housing.

Variation 12 may include a product according to variation 11 wherein an opening may extend through the bearing housing from a diffuser channel to the annular groove. The opening may enter the annular groove at a port located between the retainer and the collar.

Variation 13 may include a product according to any of variations 8 through 12 wherein the collar may include a cavity. An opening may extend through the bearing housing from a diffuser channel to the annular groove. The opening may enter the annular groove at a port. The port may be aligned with the cavity.

Variation 14 may include a product according to variation 8 and may include a diffuser channel. The collar may include a disk section extending along the diffuser channel and a spring section joining with the disk section. The spring section may bias the disk section to vary the diffuser channel in response to a pressure generated by the compressor wheel.

Variation 15 may involve a turbocharger system and may include a housing assembly having a compressor wheel cavity and a bearing cavity. A compressor wheel may be rotatably disposed in the compressor wheel cavity. A bearing may be disposed in the bearing cavity. A shaft may be connected to the compressor wheel and may extend through the bearing for support. The compressor wheel may include a circumferential tip. A diffuser channel may extend through the housing assembly from the compressor wheel cavity to a collection volute. The housing assembly may have an annular groove facing the diffuser channel near the circumferential tip. A collar may be slidably disposed in the annular groove. The collar may slide into and out of the diffuser channel in response to a pressure generated by a rotational speed of the compressor wheel.

Variation 16 may include a turbocharger assembly according to variation 15 and may include a spring disposed in the annular groove behind the collar and biasing the collar out of the annular groove.

Variation 17 may include a turbocharger assembly according to variation 16 and may include a retainer engaged in the housing assembly, the retainer may hold the collar in the annular groove.

Variation 18 may include a turbocharger assembly according to variation 17 wherein an opening may extend through the housing assembly from the diffuser channel to the annular groove. The opening may enter the annular groove at a port located between the retainer and the collar.

Variation 19 may include a turbocharger assembly according to variation 15 wherein the collar may include a cavity with an opening extending through the housing assembly from the diffuser channel to the annular groove. The opening may enter the annular groove at a port that is aligned with the cavity.

Variation 20 may include a turbocharger assembly according to variation 15 wherein the collar may include a disk section extending along the diffuser channel and a spring section joining with the disk section and biasing the disk section to vary the diffuser channel in response to a pressure generated by a rotational speed of the compressor wheel.

The above description of select variations within the scope of the invention is merely illustrative in nature and, thus, variations or variants thereof are not to be regarded as a departure from the spirit and scope of the invention.

What is claimed is:

1. A product for inhibiting oil from entering a turbocharger compressor comprising: a housing with a compressor wheel disposed in a wheel chamber of the housing to rotate at a range of speeds, the compressor wheel surrounded by a collection volute with a diffuser channeling air from the wheel chamber to the collection volute; a shaft extended through the housing, the shaft connected to the compressor wheel and the shaft supported by a bearing, the bearing lubricated through an oil circuit; wherein a pressure differential between the wheel chamber and the oil circuit inhibits oil from entering the wheel chamber; and wherein the pressure differential is maintained during rotation of the compressor wheel at a low end of the range of speeds by a collar disposed near a tip of the compressor wheel at an entrance to the diffuser, and a retainer engaged in the housing, the retainer holding the collar in a groove of the housing, wherein an opening extends through the housing from the diffuser to the groove, the opening entering the groove at a port located between the retainer and the collar.

2. The product according to claim 1 further comprising a spring biasing the collar toward the wheel, wherein during rotation of the wheel at speeds above the low end of the range of speeds, the pressure differential causes the collar to slide to compress the spring.

3. The product according to claim 2 wherein during rotation of the wheel at the low end of the range of speeds the spring biases the collar to direct air from a tip of the wheel to a shaft side of the wheel, to increase pressure on the shaft side of the wheel.

4. The product according to claim 2 wherein the spring is disposed in a chamber of the housing behind the collar and wherein a vent extends from the chamber and through the housing.

5. The product according to claim 1 wherein the collar includes a cavity, and wherein the port is aligned with the cavity.

6. A product for inhibiting oil from entering a turbocharger compressor comprising: a housing with a compressor wheel disposed in a wheel chamber of the housing to rotate at a range of speeds, the compressor wheel surrounded by a collection volute with a diffuser channeling air from the wheel chamber to the collection volute; a shaft extended through the housing, the shaft connected to the compressor wheel and the shaft supported by a bearing, the bearing lubricated through an oil circuit; wherein a pressure differential between the wheel chamber and the oil circuit inhibits oil from entering the wheel chamber; and wherein the pressure differential is maintained during rotation of the compressor wheel at a low end of the range of speeds by a collar disposed near a tip of the compressor wheel at an entrance to the diffuser, wherein the collar includes a disk section extending along the diffuser and a spring section joining with the disk section and biasing the disk section to vary the diffuser in response to the pressure differential.

7. A product for use with a turbocharger comprising: a compressor wheel connected to and rotating with a shaft, the compressor wheel disposed in a compressor housing, wherein rotation of the compressor wheel generates a pressure that varies; a bearing disposed in a bearing housing, the bearing rotatably supporting the shaft, the bearing housing including an annular groove formed in a radial location outside a circumferential tip of the compressor wheel; and a collar disposed in the annular groove, wherein at least a part of the collar moves in the groove in an outward direction when the compressor wheel rotates at a relatively slow speed and at least the part of the collar moves in the groove in an inward direction solely in response to the pressure when the compressor wheel rotates at a relatively fast speed.

8. The product according to claim 7 wherein the compressor wheel includes a tip on a radial outer circumference of the compressor wheel, and wherein a diffuser extends outward from the tip, rotation of the compressor wheel generating a flow through the diffuser, and further comprising a spring biasing the collar in the outward direction wherein during rotation of the compressor wheel at the relatively fast speed, a pressure differential causes the collar to slide in the inward direction, moving the collar completely into the annular groove so that the diffuser is fully open from the tip radially outward, without the collar restricting flow.

9. The product according to claim 7 wherein the compressor wheel includes a first side with a number of vanes and a back side opposite the first side, wherein during rotation of the compressor wheel at the relatively low speed, a spring causes the collar to slide in the outward direction from the back side of the compressor wheel toward the first side wherein the collar directs at least part of the pressure to the back side of the compressor wheel.

10. The product according to claim 7 further comprising a retainer engaged in the bearing housing, the retainer holding the collar in the annular groove of the bearing housing.

11. The product according to claim 7 wherein the compressor wheel includes a first side that has a number of vanes and a back side opposite the first side, wherein the back side faces the bearing housing so that a space is defined between the back side and the bearing housing and wherein the collar is positioned directly radially outside both the space and a part of the compressor wheel.

12. A product for use with a turbocharger comprising: a compressor wheel connected to and rotating with a shaft, the compressor wheel disposed in a compressor housing, wherein rotation of the compressor wheel generates a pressure that varies; a bearing disposed in a bearing housing, the bearing rotatably supporting the shaft, the bearing housing including an annular groove formed in a radial location outside a circumferential tip of the compressor wheel; and a collar disposed in the annular groove, wherein at least a part of the collar moves in the groove in an outward direction when the compressor wheel rotates at a relatively slow speed and at least the part of the collar moves in the groove in an inward direction solely in response to the pressure when the compressor wheel rotates at a relatively fast speed, and a retainer engaged in the bearing housing, the retainer holding the collar in the annular groove of the bearing housing, wherein an opening extends through the bearing housing from a diffuser channel to the annular groove, the opening entering the annular groove at a port located between the retainer and the collar.

13. A product for use with a turbocharger comprising: a compressor wheel connected to and rotating with a shaft, the compressor wheel disposed in a compressor housing, wherein rotation of the compressor wheel generates a pressure that varies; a bearing disposed in a bearing housing, the bearing rotatably supporting the shaft, the bearing housing including an annular groove formed in a radial location outside a circumferential tip of the compressor wheel; and a collar disposed in the annular groove, wherein at least a part of the collar moves in the groove in an outward direction when the compressor wheel rotates at a relatively slow speed and at least the part of the collar moves in the groove in an inward direction solely in response to the pressure when the compressor wheel rotates at a relatively fast speed, wherein the collar includes a cavity, wherein an opening extends through the bearing housing from a diffuser channel to the annular groove, the opening entering the annular groove at a port, the port aligned with the cavity.

14. A product for use with a turbocharger comprising: a compressor wheel connected to and rotating with a shaft, the compressor wheel disposed in a compressor housing, wherein rotation of the compressor wheel generates a pressure that varies; a bearing disposed in a bearing housing, the bearing rotatably supporting the shaft, the bearing housing including an annular groove formed in a radial location outside a circumferential tip of the compressor wheel; and a collar disposed in the annular groove, wherein at least a part of the collar moves in the groove in an outward direction when the compressor wheel rotates at a relatively slow speed and at least the part of the collar moves in the groove in an inward direction solely in response to the pressure when the compressor wheel rotates at a relatively fast speed, and a diffuser channel wherein the collar includes a disk section extending along the diffuser channel and a spring section joining with the disk section and biasing the disk section to vary the diffuser channel in response to a pressure generated by the compressor wheel.

15. A turbocharger system comprising: a housing assembly having a compressor wheel cavity and a bearing cavity; a compressor wheel rotatably disposed in the compressor wheel cavity; a bearing disposed in the bearing cavity; a shaft connected to the compressor wheel and extending through the bearing for support; wherein the compressor wheel includes a circumferential tip; wherein a diffuser channel extends through the housing assembly from the compressor wheel cavity to a collection volute; wherein the housing assembly has an annular groove facing the diffuser channel near the circumferential tip; wherein a collar is slidably moveably disposed in the annular groove, the collar sliding into and out of the diffuser channel in response to a pressure generated by a rotational speed of the compressor wheel, a spring disposed in the annular groove behind the collar, the spring biasing the collar out of the annular groove, a retainer engaged in the housing assembly, the retainer holding the collar in the annular groove wherein an opening extends through the housing assembly from the diffuser channel to the annular groove, the opening entering the annular groove at a port located between the retainer and the collar.

16. The turbocharger system according to claim 15 wherein the collar includes a cavity, wherein the port is aligned with the cavity.

17. A product for use with a turbocharger comprising: a compressor wheel connected to and rotating with a shaft, the compressor wheel disposed in a compressor housing, wherein rotation of the compressor wheel generates a pressure that varies; a bearing disposed in a bearing housing, the bearing rotatably supporting the shaft, the bearing housing including an annular groove formed in a radial location outside a circumferential tip of the compressor wheel; and a collar disposed in the annular groove, wherein at least a part of the collar moves in the groove in an outward direction when the compressor wheel rotates at a relatively slow speed and at least the part of the collar moves in the groove in an inward direction solely in response to the pressure when the compressor wheel rotates at a relatively fast speed, and a retainer engaged in the bearing housing, the retainer holding the collar in the annular groove of the bearing housing, and a spring biasing the collar in the outward direction, wherein the spring is disposed in a chamber of the annular groove behind the collar, wherein a vent extends from the chamber and through the housing, and wherein an opening extends through the retainer, the opening registering with the vent.

* * * * *